US008528139B2

(12) United States Patent
Hardaway

(10) Patent No.: US 8,528,139 B2
(45) **Date of Patent: *Sep. 10, 2013**

(54) LAUNDRY TREATING APPLIANCE WITH BIOFILM TREATING CYCLE

(75) Inventor: Anthony H. Hardaway, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/597,594

(22) Filed: Aug. 29, 2012

(65) Prior Publication Data

US 2012/0317730 A1 Dec. 20, 2012

Related U.S. Application Data

(63) Continuation of application No. 12/967,433, filed on Dec. 14, 2010.

(51) Int. Cl.
*D06F 33/02* (2006.01)
*D06F 39/06* (2006.01)

(52) U.S. Cl.
USPC ..... 8/158

(58) Field of Classification Search
USPC ..... 8/149.1, 149.2, 149.3, 158, 159; 68/12.02, 12.05, 12.12, 12.19, 12.21, 12.23, 68/12.27
See application file for complete search history.

(56) References Cited

U.S. PATENT DOCUMENTS

| | | | | |
|---|---|---|---|---|
| 6,523,205 | B1 * | 2/2003 | Broker et al. | 8/158 |
| 2007/0012074 | A1 * | 1/2007 | Hong et al. | 68/12.21 |
| 2007/0151311 | A1 * | 7/2007 | McAllister et al. | 68/3 R |
| 2007/0295037 | A1 * | 12/2007 | Blomberg et al. | 68/17 R |
| 2008/0092602 | A1 * | 4/2008 | Quddus et al. | 68/5 C |
| 2008/0092928 | A1 * | 4/2008 | Wong et al. | 134/30 |
| 2008/0276655 | A1 * | 11/2008 | Luckman et al. | 68/12.12 |
| 2009/0056034 | A1 * | 3/2009 | Herkle et al. | 8/149.3 |
| 2009/0056035 | A1 * | 3/2009 | Herkle et al. | 8/149.3 |
| 2009/0056036 | A1 * | 3/2009 | Herkle et al. | 8/149.3 |
| 2009/0056175 | A1 * | 3/2009 | Pinkowski et al. | 38/77.7 |
| 2009/0056387 | A1 * | 3/2009 | Beck et al. | 68/5 C |
| 2009/0056388 | A1 * | 3/2009 | Beck et al. | 68/5 C |
| 2009/0056389 | A1 * | 3/2009 | Pinkowski et al. | 68/5 C |
| 2009/0056762 | A1 * | 3/2009 | Pinkowski et al. | 134/22.15 |

* cited by examiner

*Primary Examiner* — Joseph L Perrin
(74) *Attorney, Agent, or Firm* — Clifton G. Green; McGarry Bair PC

(57) ABSTRACT

The invention relates to a method of operating a laundry treating appliance having a rotatable drum defining a rotatable treating chamber. The operation of the laundry treating appliance may determine the presence of an over-sudsing condition to execute a biofilm treating cycle based on the presence of the over-sudsing condition determined.

17 Claims, 4 Drawing Sheets

LAUNDRY TREATING APPLIANCE WITH BIOFILM TREATING CYCLE

CROSS REFERENCE TO RELATED APPLICATIONS

This application is a continuation of U.S. patent application Ser. No. 12/967,433, filed Dec. 14, 2010, which is hereby incorporated by reference.

BACKGROUND OF THE INVENTION

Contemporary laundry treating appliances, such as a clothes washing machine, may be provided with a treating chamber for receiving a laundry load for treatment, such as washing and rinsing the laundry load. The laundry load may be treated in the treating chamber according to a cycle of operation using one or more treating chemistries. Some laundry treating appliances have a biofilm cleaning cycle, which may be manually selected by the user.

SUMMARY OF THE INVENTION

A laundry treating appliance capable of determining a presence of an over-sudsing condition in the appliance during the implementation of a treating cycle of operation, and automatically initiating the implementation of a biofilm treating cycle as a function of the determined presence of an over-sudsing condition.

DESCRIPTION OF EMBODIMENTS OF THE INVENTION

The invention is generally directed toward a clothes washing machine with a biofilm treating cycle. One aspect of the invention is to sense an over-sudsing condition and initiate the biofilm treating cycle. A beneficial result of the biofilm treating cycle is that the formation and/or growth of the biofilm in the appliance can be prevented or limited. The invention addresses problems associated with determining and removing over-sudsing condition in the interior of the tub of the clothes washing machine.

Figure 1:
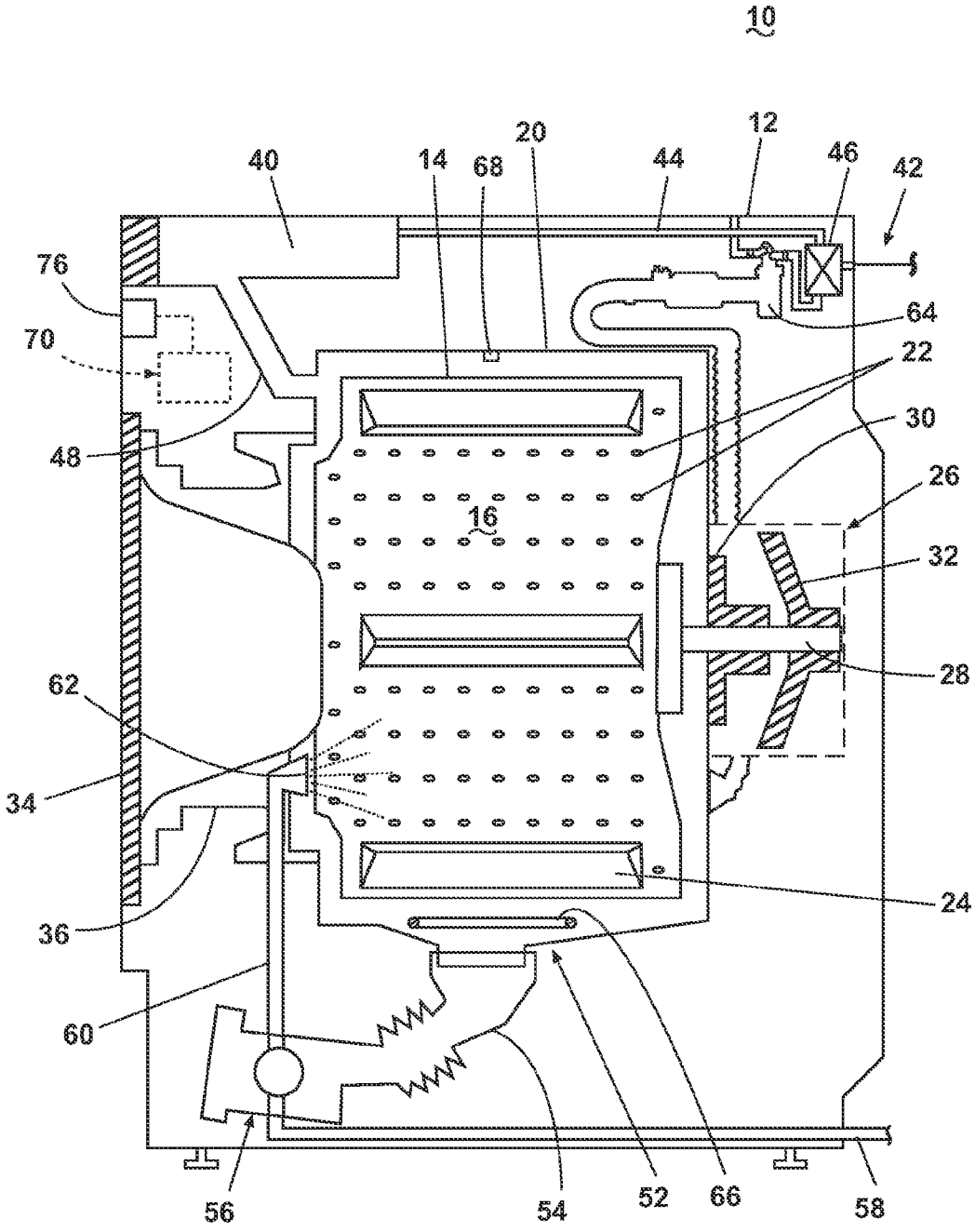
FIG. 1 is a schematic, cross-sectional view of a laundry treating appliance in the form of a clothes washing machine according to an embodiment of the invention.

FIG. 1 is a schematic view of a laundry treating appliance 10 in the form of a horizontal-axis clothes washing machine 10 according to a first embodiment of the invention. While the laundry treating appliance is illustrated as a horizontal-axis clothes washing machine 10, the laundry treating appliance according to the invention may be any appliance which performs a cycle of operation on laundry in the treating chamber using one or more treating chemistries, non-limiting examples of which include a horizontal or vertical axis clothes washing machine; an automatic dryer; a combination washing machine and dryer; a tumbling or stationary refreshing/revitalizing machine; an extractor; a non-aqueous washing apparatus; and a revitalizing machine.

Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes washing machine 10. The clothes washing machine 10 described herein shares many features of a traditional automatic clothes washing machine, which will not be described in detail except as necessary for a complete understanding of the invention.

The washing machine 10 may have a cabinet 12 that includes a rotatable drum 14 defining the treating chamber 16 and which may be located within a tub 20 for receiving laundry to be treated during a cycle of operation. The rotatable drum 14 may include a plurality of perforations 22, such that liquid may flow between the tub 20 and the drum 14 through the perforations 22. The drum 14 may further include a plurality of lifters 24 disposed on an inner surface of the drum 14 with predetermined gaps between the lifters 24 to lift the laundry load received in the treating chamber 16 while the drum 14 rotates.

While the illustrated washing machine 10 includes both the tub 20 and the drum 14, with the drum 14 defining the laundry treating chamber 16, it is within the scope of the invention for the washing machine 10 to include only one receptacle, with the receptacle defining the laundry treating chamber 16 for receiving the laundry load to be treated.

A motor 26 may be directly coupled with the drive shaft 28 to rotate the drum 14 at a predetermined speed and direction. The motor 26 may be a brushless permanent magnet (BPM) motor having a stator 30 and a rotor 32. Alternately, the motor 26 may be coupled to the drum 14 through a belt and a drive shaft to rotate the drum 14, as is known in the art. Other motors, such as an induction motor or a permanent split capacitor (PSC) motor, may also be used. The motor 26 may rotate the drum 14 at various speeds in either rotational direction.

Both the tub 20 and the drum 14 may be selectively closed by a door 34. A bellows 36 couples an open face of the tub 20 with the cabinet 12, and the door 34 seals against the bellows 36 when the door 34 closes the tub 20.

A treatment dispenser 40 may be provided to the clothes dryer 10 to dispense a treating chemistry during a drying cycle. As illustrated, the treatment dispenser 40 may be located in the interior of the cabinet 12 such that the treating chemistry may be dispensed to the interior of the tub 20, although other locations are also possible. The treatment dispenser 40 may include a reservoir of treating chemistry that is releasably coupled to the treatment dispenser 40, which dispenses the treating chemistry from the reservoir to the treating chamber 16. The treating chemistry may be any type of chemistry for treating laundry, and non-limiting examples include, but are not limited to detergents, surfactants, enzymes, fabric softeners, sanitizers, de-wrinklers, and chemicals for imparting desired properties to the laundry, including stain resistance, fragrance (e.g., perfumes), insect repellency, and UV protection.

The washing machine 10 may further include a liquid supply and recirculation system. Liquid, such as water, may be supplied to the washing machine 10 from a water supply 42, such as a household water supply. A supply conduit 44 may fluidly couple the water supply 42 to the tub 20 and the treatment dispenser 40. The supply conduit 44 may be provided with an inlet valve 46 for controlling the flow of liquid from the water supply 42 through the supply conduit 44 to either the tub 20 or the treatment dispenser 40.

A liquid conduit 48 may fluidly couple the treatment dispenser 40 with the tub 20. The liquid conduit 48 may couple with the tub 20 at any suitable location on the tub 20 and is shown as being coupled to a front wall of the tub 20 in FIG. 1 for exemplary purposes. The liquid that flows from the treatment dispenser 40 through the liquid conduit 48 to the tub 20 typically enters a space between the tub 20 and the drum 14 and may flow by gravity to a sump 52 formed in part by a lower portion of the tub 20. The sump 52 may also be formed by a sump conduit 54 that may fluidly couple the lower portion of the tub 20 to a pump 56. The pump 56 may direct fluid to a drain conduit 58, which may drain the liquid outside the washing machine 10, or to a recirculation conduit 60, which may terminate at a recirculation inlet 62. The recirculation inlet 62 may direct the liquid from the recirculation conduit 60 into the drum 14 or tub 20. The recirculation inlet 62 may introduce the liquid into the drum 14 or tub 20 in any suitable manner, such as by spraying, dripping, or providing a steady flow of the liquid.

The liquid supply and recirculation system may further include one or more devices for heating the liquid such as a steam generator 64 and/or a sump heater 66. The steam generator 64 may be provided to supply steam to the treating chamber 16, either directly into the drum 14 or indirectly through the tub 20 as illustrated. The inlet valve 46 may also be used to control the supply of water to the steam generator 64. The steam generator 64 is illustrated as a flow through steam generator, but may be other types, including a tank type steam generator. Alternatively, the heating element 66 may be used to heat laundry (not shown), air, the rotatable drum 14, or liquid in the tub 20 to generate steam, in place of or in addition to the steam generator 64. The steam generator 64 may be used to heat to the laundry as part of a cycle of operation, much in the same manner as heating element 66, as well as to introduce steam to treat the laundry.

Additionally, the liquid supply and recirculation system may differ from the configuration shown in FIG. 1, such as by inclusion of other valves, conduits, treatment dispensers, sensors, such as water level sensors and temperature sensors, and the like, to control the flow of liquid through the washing machine 10 and for the introduction of more than one type of detergent/wash aid. Further, the liquid supply and recirculation system need not include the recirculation portion of the system or may include other types of recirculation systems.

One or more sensors 68, such as a surfactant sensor or turbidity sensor, may be provided to the washing machine 10 to sense and/or determine an over-sudsing condition formed in the interior of the tub 20 during a cycle of operation. As illustrated, the sensor 68 may be positioned on upper portion of the inner surface of tub 20 while other locations inside the tub 20 may be possible. For example, the sensor 68 may be also placed outside the tub 20, yet still within the cabinet 12.

Figure 2:
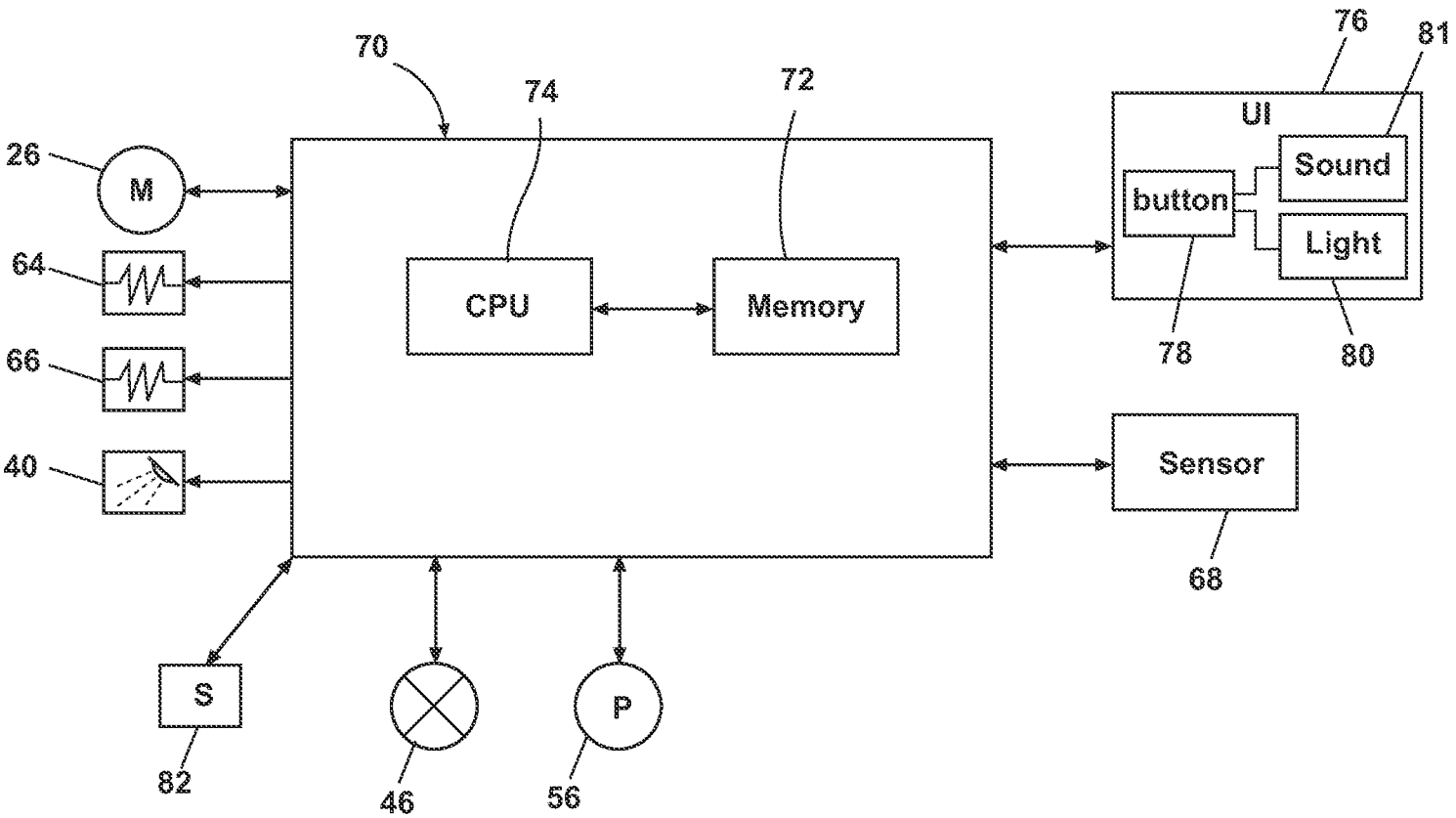
FIG. 2 is a schematic view of a controller of the clothes washing machine of FIG. 1.

A controller 70 may be provided in the cabinet 12 and communicably couple one or more components to receive an output signal from components and control the operation of the washing machine 10 to implement one or more cycles of operation, which is further described in detail with reference to FIG. 2. The controller 70 may be provided with a memory 72 and a central processing unit (CPU) 74. The memory 72 may be used for storing the control software that is executed by the CPU 74 in completing a cycle of operation using the washing machine 10 and any additional software. For example, the memory 72 may store one or more pre-programmed cycles of operation that may be selected by a user and completed by the washing machine 10. The memory 72 may also be used to store information, such as a database or look-up table, and to store data received from one or more components of the washing machine 10 that may be communicably coupled with the controller 70.

The controller 70 may be operably coupled with one or more components of the laundry treating appliance 10 for communicating with and controlling the operation of the component to complete a cycle of operation. For example, the controller 70 may be coupled with a user interface 76 for receiving user selected inputs and communicating information with the user. The user interface 76 may be provided that has operational controls such as dials, lights, knobs, levers, buttons, switches, sound device, and displays enabling the user to input commands to a controller 70 and receive information about a specific cleaning cycle from sensors (not shown) in the washing machine 10 or via input by the user through the user interface 76.

The user may enter many different types of information, including, without limitation, cycle selection and cycle parameters, such as cycle options. Any suitable cycle may be used. Non-limiting examples include, Heavy Duty, Normal, Delicates, Rinse and Spin, Sanitize, and Bio-Film Clean Out. The term "cleaning cycle" is used to mean one operational cycle of the washing machine 10 that cleans a load of laundry.

The controller 70 may be further operably coupled to the motor 26 for controlling the direction and speed of rotation of the drum 14, and the treatment dispenser 40 for dispensing a treating chemistry during a cycle of operation. The controller 70 may be coupled to the steam generator 64 and the sump heater 66 to heat the liquid as required by the controller 70. The controller 70 may be also coupled to the pump 56 and inlet valve 46 for controlling the flow of liquid during a cycle of operation.

The controller 70 may further be coupled to the sensor 68 to receive input used to sense the presence of the over-sudsing condition. The controller 70 may also receive input from one or more additional sensors 82, non-limiting examples of which include: a treating chamber temperature sensor, a weight sensor, a conductivity sensor, a position sensor, and a motor torque sensor.

Figure 3:
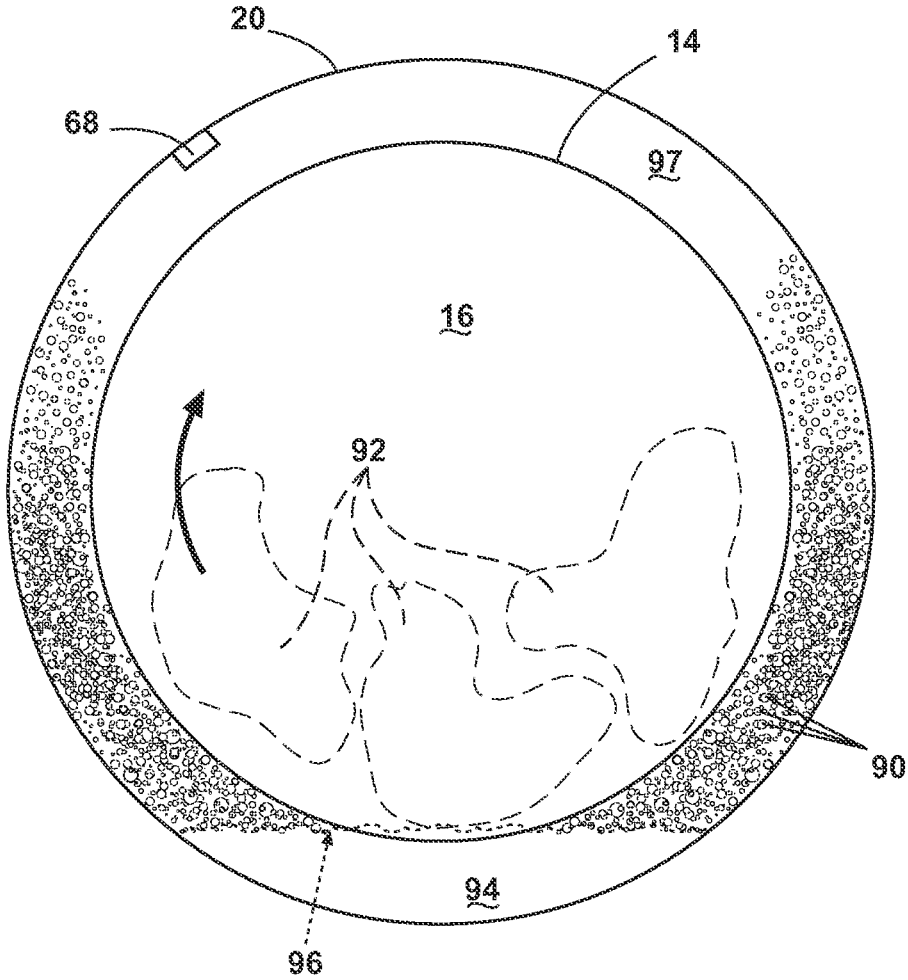
FIG. 3 is a schematic, front view of a tub and rotatable drum during an over-sudsing condition, illustrated by suds.

FIG. 3 is a schematic, front view of the tub 20 and rotatable drum 14 during the over-sudsing condition illustrated by suds 90. During normal washing operation, the drum 14 is rotated to tumble the laundry 92 in a wash liquid 94 having an operational liquid level 96 that is high enough to immerse a lower portion of the drum 14, such that the laundry 92 is tumbled in the wash liquid 94. During a normal tumbling operation, the suds do not rise much higher than the operational liquid level 96. However, during the over-sudsing condition, such as when excess detergent or other suds-generating treating chemistry is supplied to the tub 20, the excessive suds will rise to a much high level in the space 97 between the tub 20 and drum 14.

It is noted that some treating chemistries for a washing cycle may be capable of creating suds, which float and deposit soils and undissolved detergent ingredients including surfactants onto the surface of the parts of the clothes washing machine 10. For the washing machine 10, it is also noted the deposition tends to build up in areas that are not submerged and/or flushed with adequate volumes of water during standard use of the washing machine 10 and provide a food supply for micro-organisms that are airborne and introduced into the washing machine 10 with the clothes and accompanying soils. As a result, biofilm can form and grow on the washing machine surfaces, and the biofilm can lead to odor emanating from the washing machine 10 and exposure of the laundry load to the micro-organisms during a cycle of operation. In addition, the over-sudsing condition may be unfavorable to the operation of the clothes washing machine 10. For example, the suds or biofilm deposit may adversely effect the treating efficiency of the laundry load by providing less frictional wall of the rotatable treating chamber 16 against the laundry load during a tumbling process.

It is further noted that the suds may not typically form below a predetermined operational liquid level in the tub, while the suds may be readily observed above a predetermined operational liquid level in the tub. This may imply that the suds may be naturally or inherently cleaned out in the presence of liquid. It is also noted that the over-sudsing condition may be observed in the interior of the treating chamber 16, the over-sudsing condition can be typically observed exterior of the treating chamber 16 during a cycle of operation, which implies that the centrifugal movement of rotatable drum 14 may move a portion of the excessive suds formed in the interior of the treating chamber 16 outward. For example, during an operation of the clothes washing machine 10, the suds, once formed in the treating chamber 16, may move outside the treating chamber 16 through perforations (not shown here), move upward along the surface of the treating chamber 16 and/or tub 20, eventually fill out the space between the tub 20 and the treating chamber 16.

During normal operating conditions, the level of a mixture including the liquid and suds rarely, if ever, rises to a height more than 25% of the diameter of the drum above the lowest point of drum. During the over-sudsing conditions, the suds may completely fill the space 97. Thus, under normal operating conditions, the wash liquid will not reach all areas where suds may reside from the over-sudsing condition and will not naturally clean all such areas of the suds. As the suds may contain bacteria and other items from which a biofilm may develop, areas in the appliance where suds have resided and which are not naturally cleaned by the normal washing process are areas susceptible to the growth of biofilm. While sources other than suds may cause the development of biofilm, suds are one of the more common sources in laundry treating appliance.

The problem of biofilm initiation and growth is addressed by the invention by responding to the presence of suds in areas (the affected areas) that are not normally cleaned by the wash liquid during the normal operation of the laundry treating appliance. The over-sudsing condition is one of the more likely sources of suds in the affected areas.

The problem is addressed by locating at least one sensor 68 in the affected areas, such as in the space 97. The sensor 68 is of the type that can detect the presences and/or degree of sudsing. Non-limiting examples of the sensor 68 include a surfactant sensor or turbidity sensor although any other sensors sensing a refractive index, capacitance, surface tension, or turbidity of the suds or suds-containing liquid may be used.

Once the over-sudsing condition is determined, the possible results, such as the creation and growth of the biofilm, may be addressed by executing a biofilm treating cycle. There are a variety of ways to treat for biofilm. One approach is to apply heat to the affected areas to kill some or all of the biofilm, such as by heating the air within the treating chamber 16 using at least one of the sump heater 66 and steam generator 64 to a predetermined temperature for a predetermined time, with or without presence of liquid in the tub 20. The surface of the treating chamber 16 or tub 20 or other structure on which the biofilm may grow may be heated to the predetermined temperature for the predetermined time, in place of or in addition to heating air. The heating temperature and time may be configured to provide the air or surface of the treating chamber 16, tub 20, or other structure with enough heat energy to loosen the biofilm structure, which may then be washed away with liquid supplied to the treating chamber. The liquid may include a bio-reducer, such as a biocide, which chemically retards or kills the biofilm. The drum 14 may be rotated to aid in distributing the liquid within the interior of the appliance.

Liquid, such as water or other treating chemistry, may be used, with or without heat, to eliminate the over-sudsing condition. In the simplest scenario, a liquid, such as water, may be provided to the interior of the tub 20. During the supply of the water in the tub 20, the treating chamber 16 may rotate relative to the tub 20 to a predetermined speed, while the drum 14 may be stationary. The treating camber 16 may rotate after the water is supplied to the tub 20 to fluidly couple the suds to the water and loose off the structure of the suds. Additional sprays of liquid may be provided to the tub 20 to further loosen or rinse out remaining suds to the drain conduit 58 of the washing machine 10.

The liquid may include bio-reducer, which is anything that kills, reduces, retards, or limits the growth of the suds or biofilm. The bio-reducer may include a biocide, such as an antimicrobial, disinfectant, and sanitizer that may kill or otherwise treat the suds or biofilm. Exemplary biocides include bleaches, such as peroxide bleached; other oxidizing chemicals; Microban™ chemicals; silver, copper and zinc ions. The biocide may also be introduced in the interior of the treating chamber 16, combined with the aforementioned heating step, but some chemicals, such as chlorine bleach, may be negatively effected by the heat (e.g., the heat may weaken the bleach and/or make the bleach corrosive). The bio-reducer may be combined with any of the described methods. It may even be the liquid from which the steam is generated.

Figure 4:
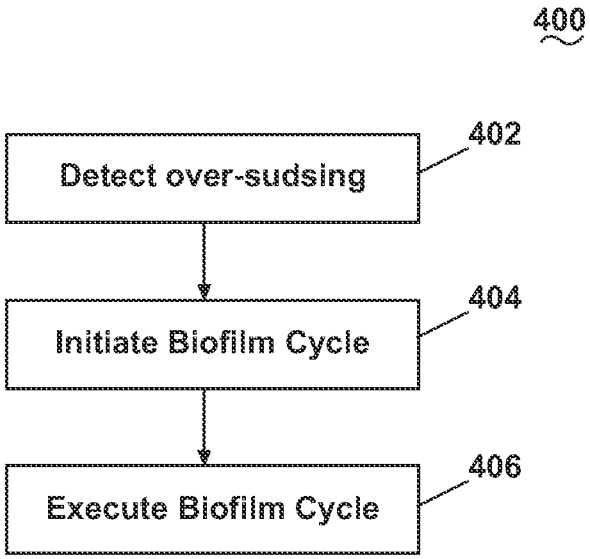
FIG. 4 is a flow chart for operating the clothes washing machine according to another embodiment of the invention.

FIG. 4 is a flow chart for operating the clothes washing machine 10 according to another embodiment of the invention. The sequence of steps depicted in FIG. 4 is for illustrative purposes only, and is not meant to limit the method in any way as it is understood that the steps may proceed in a different logical order, additional or intervening steps may be included, or described steps may be divided into multiple steps, without detracting from the invention. The method may be incorporated into a cycle of operation for the clothes washing machine, such as prior to or as part of any phase of the wash cycle, such as a wash phase, rinse phase, or drying phase. The method may also be a stand-alone cycle. It is noted that the method may be used with or without the laundry placed within the treating chamber.

The method 400 begins at 402 by detecting the over-sudsing in the interior of the tub 20. The detection of over-sudsing may be implemented by the sensor 68. When the sensor 68 detects the presence of the over-sudsing condition, the sensor 68 may send the output signal indicative of the over-sudsing condition to the controller 70. Separate from using the sensor 68, the over-sudsing may be alternatively detected by monitoring the parameters of the motor 26, such as the change of speed, torque, power, or current, which may be indicative of a change of duty, for example a load increase, from the over-sudsing condition, which is a known art.

At 404, the biofilm treating cycle may initiate when the over-sudsing condition is detected by the sensor 68 in the clothes washing machine 10. The initiating of the biofilm treating cycle includes automatically initiating the biofilm treating cycle as well as indicating to the user that the cycle should/could be executed. For example, when the controller 70 receives the output signal from the sensor 68, the controller 70 may communicate with the user interface 76 to provide an indicia of the presence of the over-sudsing condition, which is an indication of a need for an execution of a biofilm treating cycle, or the user interface 76 may provide a notification to the user using indicia that the biofilm treating cycle may be a selectable option. The user interface 76 may be provided with any visual indicator, for example, a light 80 or the like, such that the light 80 may be on when the controller 70 sends the output signal indicative to the over-sudsing condition to the user interface 76. Alternatively, the user interface 76 may be provided with any sound indicator, for example, an alarm 81 (or speaker), in addition to or in replace of the visual indicator 80. The user interface 76 may optionally be provided with a button 78 that may be operably coupled to the light 80 or alarm 81. The user may press the button 78 when the user acknowledges the light from the light 80 or alarm 81 and/or want to select the execution of the biofilm treating cycle.

Alternatively, with or without providing any indication of the over-sudsing condition and/or the need for the biofilm treating cycle on the user interface 76, the controller 70 may automatically initiate the execution of the biofilm treating cycle. The biofilm treating cycle may be initiated during the current cycle of operation that caused the over-sudsing condition. The current cycle of operation may be terminated and then the biofilm treating cycle initiated. The biofilm treating cycle may also be initiated after the completion of the current cycle of operation. The initiation may be before or after the laundry from the current cycle of operation is removed from the treating chamber.

At 406, the biofilm treating cycle may be executed. The executed biofilm treating cycle may include any suitable treating method, including any combination of the previously described methods. The biofilm treating cycle may be a stand alone cycle. Alternatively, the biofilm treating cycle may be executed during, before, or after the current wash cycle. In another embodiment, the biofilm treating cycle may be a part of the subsequent wash cycles.

It is noted that the execution of the biofilm treating cycle may be controlled in many ways. In one embodiment, the biofilm treating cycle may be executed immediately when the over-sudsing condition is detected. For example, the biofilm treating cycle may be executed immediately by the controller 70 after the user is notified of any one-time over-sudsing condition through any visible or aural indicator coupled to the user interface 76.

The biofilm treating cycle may be executed anytime when the controller 70 notifies the user that the biofilm treating cycle may be one of the selectable options, until a predetermined number of presences of the over-sudsing are recorded. The biofilm treating cycle may be deferred until a predetermined number of determinations of the over-sudsing is recorded and inputted to the controller 70. The biofilm treating cycle may be automatically executed once the predetermined number of sudsing conditions is satisfied. Alternatively, the user may hold the execution of the biofilm treating cycle such that the biofilm cycle may be executed later.

It is also noted that the biofilm treating cycle may be executed prior to a removal of the laundry from the treating chamber 16, while the biofilm treating cycle may be implemented after a removal of the laundry from the treating chamber 16. For example, the user may typically wish to implement the biofilm treating cycle in the absence of the laundry load due to the possibility of cross-contamination. Specifically, in case the biofilm treating cycle is implemented in the presence of the laundry in the treating chamber 16, it may be probable that the laundry load would be unnecessarily contaminated by the liquid such as the bleach. The laundry may be also additionally contaminated by a portion of the suds or biofilm that are decoupled as the result of the biofilm treating cycle from the surface of the drum 14 or the tub 20, which would diminish the laundry treating efficiency. The biofilm treating cycle may be designed both for cleaning out of suds or treating the laundry load. For example, the user may dispense the bleach for both biofilm treating cycle and bleaching the laundry load, and the biofilm treating cycle using the bio-reducer may occur prior to the removal of the laundry from the treating chamber 16.

It is further noted that the degree of the cleaning by the biofilm treating cycle may correspond to the degree of the over-sudsing. That is, the greater the over-sudsing the greater the cleaning effect of the biofilm treating cycle. For example, when an abnormally large over-sudsing event occurs or the biofilm treating cycle is executed only after multiple determinations of the over-sudsing condition, it may be expected that a greater degree of cleaning is needed. A greater degree of cleaning may be accomplished by extending the duration of any of the previously described biofilm treating methods and/or combining multiple methods. For example, as described above, a combination of a bio-reducer and heat may limit the efficiency of the biofilm treating cycle, compared to combination of other available treating parameters.

The invention described herein provides methods for operating the laundry treating appliance such as the clothes washing machine 10 operably coupled to one or more sensors 68 to determine the over-sudsing condition. The methods of the invention can be advantageously used when the over-suds or biofilm formed in the interior of the tub 20 need to be cleaned out in the discretion of the user. The biofilm treating cycle may be notified and initiated such that the suds or biofilm are effectively prevented in the interior of the laundry treating appliance.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of preventing the creation of biofilm in and operating a laundry treating appliance having a rotatable treating chamber for receiving laundry for treatment according to an automatic cycle of operation, the method comprising:

sensing an over-sudsing condition during the automatic cycle of operation; and preventing the creation of a biofilm by initiating a biofilm treating cycle of operation in response to the sensed over-sudsing condition.

2. The method of claim 1 wherein the initiating a biofilm treating cycle of operation occurs after the completion of the automatic cycle of operation.

3. The method of claim 1 wherein the initiating a biofilm treating cycle of operation occurs prior to the completion of the automatic cycle of operation.

4. The method of claim 1 wherein the initiating a biofilm treating cycle of operation occurs during the execution of the automatic cycle of operation.

5. The method of claim 1 wherein the automatic cycle of operation is terminated prior to completion and the initiating a biofilm treating cycle of operation occurs after the termination.

6. The method of claim 1 wherein the sensing an over-sudsing condition comprises sensing the suds formed above an operational water level during the automatic cycle of operation.

7. The method of claim 1 wherein the sensing an over-sudsing condition is determined by a suds sensor.

8. The method of claim 7 wherein the suds sensor senses suds exteriorly of the rotatable treating chamber.

9. The method of claim 7 wherein the suds sensor provides a signal indicative of a presence of suds.

10. The method of claim 9 wherein the suds sensor comprises at least one of a surfactant and turbidity sensor.

11. The method of claim 1 wherein the preventing the creation of the biofilm comprises reducing an amount of the biofilm, compared to the amount of the biofilm without any biofilm treating automatic cycle of operation.

12. The method of claim 1 wherein the biofilm treating automatic cycle of operation comprises at least one of heating and liquid.

13. The method of claim 1 further comprising removing the laundry from the rotatable treating chamber.

14. The method of claim 1 wherein the initiating a biofilm treating cycle of operation occurs when the sensing of the over-sudsing condition occurs a predetermined number of times.

15. The method of claim 1 wherein the sensing an over-sudsing condition comprises sensing the presence of suds exteriorly of the rotatable treating chamber.

16. The method of claim 15 wherein the sensing the over-sudsing condition comprises sensing at least one of a surfactant and a turbidity.

17. The method of claim 16 wherein the sensing the over-sudsing condition is based on an output from a sensor.

* * * * *